US005806764A

United States Patent [19]

Neumann

[11] Patent Number: 5,806,764

[45] Date of Patent: Sep. 15, 1998

[54] TRACK

[75] Inventor: Bernhard Neumann, Gmunden, Austria

[73] Assignee: Gmundner Fertigteile Gesellschaft m.b.H. & Co. KG, Gmunden, Austria

[21] Appl. No.: 702,588

[22] PCT Filed: Dec. 22, 1995

[86] PCT No.: PCT/AT95/00252

§ 371 Date: Aug. 30, 1996

§ 102(e) Date: Aug. 30, 1996

[87] PCT Pub. No.: WO96/21063

PCT Pub. Date: Jul. 11, 1996

[30] Foreign Application Priority Data

Dec. 30, 1994 [AT] Austria ..... 2433/94

[51] Int. Cl.[6] ..... E01B 9/00

[52] U.S. Cl. ..... 238/2; 238/9; 238/382

[58] Field of Search ..... 238/382, 2, 4, 238/5, 6, 7, 8, 9, 121

[56] References Cited

U.S. PATENT DOCUMENTS

| | | | |
|---|---|---|---|
| 1,260,149 | 3/1918 | Coughlin . | |
| 1,587,691 | 6/1926 | Whittingham . | |
| 3,525,472 | 8/1970 | Sato | 238/382 |
| 4,266,719 | 5/1981 | Ortwein et al. | 238/382 |
| 4,616,395 | 10/1986 | Farese et al. | 238/7 |
| 4,775,103 | 10/1988 | Ortwein | 238/382 |

FOREIGN PATENT DOCUMENTS

| | | | |
|---|---|---|---|
| 903871 | 4/1986 | Belgium . | |
| 3118540 | 2/1982 | Denmark . | |
| 0620316 | 10/1994 | European Pat. Off. . | |
| 2817278 | 10/1979 | Germany | 238/382 |
| 3536966 | 4/1987 | Germany | 238/382 |
| 4007937 | 9/1991 | Germany | 238/382 |
| 4114803 | 11/1992 | Germany | 238/382 |
| 51605 | 4/1977 | Japan | 238/382 |
| 389663 | 7/1965 | Switzerland . | |

*Primary Examiner*—Mark Tuan Le

*Attorney, Agent, or Firm*—Sughrue, Mion, Zinn, Macpeak & Seas, PLLC

[57] ABSTRACT

In a track whose rails are laterally and downwardly supported on the rail outer side and on the rail inner side via elastic intermediate inserts (4, 6) by longitudinal carriers underneath the head portion (3), the rails (2) extend at a distance above the track structure parts located therebelow. The longitudinal carriers at the rail outer side are first console ledges (5) which are part of a base plate (10) lying under the rails (2), and the longitudinal carriers on the rail inner side are second console ledges (7) which are part of an inner plate (11) lying between the rails (2), which inner plate (11) in turn is supported on the base plate (10).

41 Claims, 2 Drawing Sheets

TRACK

BACKGROUND OF THE INVENTION

The invention relates to a track whose rails are laterally and downwardly supported on the rail outer side and on the rail inner side via elastic intermediate inserts by longitudinal carriers underneath the head portion, the rails extending at a distance above the track structure parts located therebelow.

To reduce the shocks occurring when the tracks are being used and to reduce the structure-borne noise created thereby, elastically mounted rails have been proposed for some time. Thus, e.g., in WO 92/04503 a track-substructure is described in which the rails are, supported on profiled rails as longitudinal carriers via elastic intermediate inserts, which are arranged on the rail outer and rail inner sides and which are connected with carriers consisting of prefabricated concrete parts arranged therebelow, the space underneath the foot portion of the rail being free. The carriers are interconnected by transverse struts. The profiled rails have a cross-section comprising several bends, and they are braced to each other by means of screws guided through the web of the rails. The structure of this track thus is complex, since a plurality of partially complicated structure parts are required whose mounting requires a lot of time.

SUMMARY OF THE INVENTION

To require fewer structure parts and less time, according to the invention it is provided that the longitudinal carriers at the rail outer side are first console ledges which are part of a base plate lying under the rails and that the longitudinal carriers on the rail inner side are second console ledges which are part of an inner plate lying between the rails, which inner plate in turn is supported on the base plate. The inner plate may be designed as a frame.

An advantageous embodiment of the invention consists in that on the rail outer side, the base plate comprises upwardly projecting side portions, on which the first console ledges are arranged to be integrated, and that the second console ledges are arranged to be integrated at the lateral ends of the inner plate or frame.

To equally distribute the load on the base plates and on the inner plates, and to avoid the coincidence of sites of abutment of the base plates with the sites of abutment of the inner plates, it may be advantageous that the base plate and the inner plate have equal lengths and are arranged to be longitudinally offset relative to each other by half a length.

For better static and dynamic transmissions of forces between the inner plates and the base plates, it is advantageous if the base plate and/or the inner plate comprise(s) at least one longitudinal rib to support the inner plate on the base plate, wherein preferably an elastomer band is arranged between the longitudinal rib of the base plate and of the inner plate, or between a longitudinal rib provided on the inner plate and the base plate, so as to obtain a sound absorbing effect and an elastic bedding.

A further advantageous embodiment is characterized in that the base plate comprises two upwardly directed longitudinal ribs arranged at a distance from each other, which longitudinal ribs are interrupted in their middle region or have a reduced height, and that the inner plate at its end regions includes two longitudinal ribs which register with the longitudinal ribs of the base plate. This ensures that the base and inner plates cannot be longitudinally shifted relative to each other.

To avoid bending of the elastomer bands at the transitions between the longitudinal ribs of the respective plates, and also to maintain the sound absorbing effect in this region, it is advantageous if the longitudinal ribs are designed to be chamfered at the mutual transitions to the respective plate body of the base plate or of the inner plate.

To save weight and material, the plates suitably are designed such that both the base plate and the inner plate in their middle are each provided with a preferably rectangle-shaped recess so as to form a frame, the frame optionally being provided with a closed bottom so as to increase its strength.

In a preferred embodiment, the base plate and the inner plate are designed as prefabricated parts, preferably made of ferroconcrete, polymer bonded concrete, or special concrete, which is cost-saving.

In particular instances, e.g. if the ground is less solid or is very uneven, it is advantageous if the base plate is made of site-mixed concrete.

Both, the base plate and the inner plate, are suitably provided with reinforcements to increase their strength, and these reinforcements may be slack or pretensioned.

To determine the electric potential of the base plates, preferably on the upper end of the side portions of the base plate, longitudinally extending profiles of metal are arranged, wherein the profiles of successively arranged base plates are electrically interconnected and/or connected to ground. This also additionally increases the strength of the base plate.

With the subject matter of the invention, various forms of rail sections can be utilized, and preferably the console ledges and the elastic intermediate inserts designed as elastomer profiles are adapted to the shape of the head portion, the web and the foot portion of the rail.

The particular bearing of the rails provided in the subject matter of the invention makes it seem advantageous that the rails supported by the console ledges of the base plates and of the inner plates have a foot portion designed equal to the head portion. In this manner, each rail may be used a total of four times by repeated turning thereof after it has been worn, so that it has a long usable life. It may be mentioned that rails having equally designed head and foot portions are known from U.S. 1 260 149 A.

According to another possibility for an easier installation of the rails into the plates it is advantageous if the width of the foot portion of the rails is equal to or smaller than the distance between the first and the second console ledges.

Preferably, the base plate and the inner plate are designed to have a rectangle-shaped ground plan and have equal lengths, the base plate and the inner plate being arranged to be longitudinally offset relative to each other. For arcuate track paths, it may advantageously be provided that the ground plan of the base plate has the shape of a isosceles trapezoid, and that the ground plan of the inner plate has the shape of two assembled non-isosceles trapezoids, which are both designed to correspond to the shape of one half of the base plate each.

With conically turned-off running surfaces of the wheel tires, it is advantageous if the rails are inwardly inclined for adaptation to the running surface. A preferred embodiment for inclined positioning of the rails is characterized in that the height of the elastomer profile at the rail outer side below the head portion exceeds the height of the elastomer profile at the rail inner side. Another embodiment for inclined positioning of the rails consists in that the distance of the console ledge at the rail outer side to the upper edge of the base plate exceeds the distance of the console ledge on the rail inner side to the upper edge of the inner plate.

For safety and revision reasons, advantageously the base plates, which are designed as prefabricated parts, are rigidly connected to a base at intervals of from 10 to 60 m. Preferably, metal plates are anchored in the base, fastening elements being attached to said metal plates so as to clamp the rails.

To enable a simple installation and removal of the rails it is advantageous that central recesses are provided on the inner side of the side portions of the base plate and, optionally, on the outer side of the side portions of the inner plate, the console ledges and the associated elastomer profiles being interrupted in the region of the recesses so as to enable the entry of a tool, e.g. the jaws of tongs engaging at the rails.

To increase the strength and the load bearing capacity of the base plate, advantageously broadening portions outwardly directed from the side portions may be provided on the base plate.

An embodiment of the track according to the invention which is particularly suitable with a view to installation of the rails is characterized in that the foot portion of the rails is designed as a bead, the elastomer profiles in the disassembled state each having a width corresponding to approximately half the distance between the two console ledges. Thus, it is relatively simple to insert or slide in the rails between the console ledges which are covered with the elastomer profiles, and after installation of the rails, between the elastomer profiles, the latter are secured by the bead against an upward movement. It is also suitable for the installation if the two elastomer profiles associated with one rail are formed in one piece by being connected at their lower ends.

Furthermore, for a simple installation and removal of the rails it may be advantageous if a recess is provided on the side portions of the base plate at the sites of abutment. To install the elastomer profiles, it is advantageous that a slanted recess extending from the outside to the inside, is provided on the side portions of the base plate at the sites of abutment.

To reduce the running noise of the wheels it is advantageous if walls of sound-absorbing material are attached externally to one or both sides of the side walls of the base plate.

Furthermore, it is advantageous if the upper seatengaging surfaces of the console ledges of the base plate and of the inner plate extend substantially in parallel to the lower seat-engaging surface of the head portion of the rails.

A first method of mounting the track is characterized by the steps:

a) laying elastomer bands onto the longitudinal ribs of the base plate, and laying the rails against the console ledges of the base plate, b) inserting the inner plate on the one side of the base plate in a slanted manner, and pivoting inward the inner plate into the base plate on the other side, c) sliding-in the elastomer profiles between the console ledges of the inner plate and the rails, d) pressing together the rails from the outside, and inserting the elastomer profiles between the console ledges of the base plate and the rails, e) releasing the tension of the rails towards the outer side so that the rails are braced between the elastomer profiles provided on the console ledges.

A second method of mounting the track is characterized by the steps:

a) attaching elastomer profiles to the console ledges of the inner plate and laying the rails against elastomer profiles, b) pressing the rails together from the outside, c) laying elastomer bands onto the longitudinal ribs of the base plate, and inserting the rails together with the inner plate into the base plate, d) sliding in the elastomer profiles between the console ledges of the base plate and the rails, and e) releasing the tension of the rails towards the outer side so that the rails are braced between the elastomer profiles provided on the console ledges.

A third method of mounting the track is characterized by the steps:

a) laying the elastomer bands on the longitudinal ribs of the base plate and inserting the inner plate in the base plate, b) attaching the elastomer profiles to both sides of the rails, and c) pressing-in the rails together with the elastomer profiles between the console ledges of the base plate and the console ledges of the inner plate, optionally with a metal sheet strip interposed between the console ledges.

A fourth method of mounting the track is characterized by the steps:

a) laying the elastomer bands onto the longitudinal ribs of the base plate and inserting the inner plate in the base plate, b) inserting the elastomer profiles between the console ledges of the base plate and the console ledges of the inner plate, and c) pressing-in the rails.

All the methods have in common that mounting is possible without very complex installation tools and within short period of time.

BRIEF DESCRIPTION OF THE DRAWINGS

The invention will now be further explained by way of examples and with reference to the drawings. In the drawings.

DETAILED DESCRIPTION OF THE INVENTION

Figure 1:
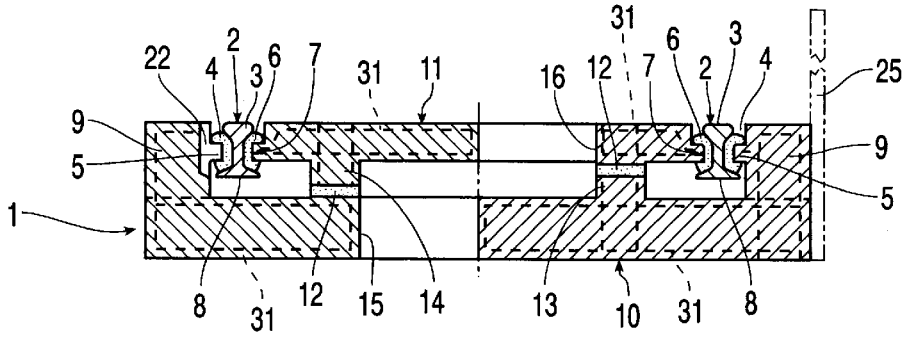
FIG. 1 shows a track according to the invention in a cross-section according to lines I—I of FIG. 2.

In FIG. 1, a track including rails 2 is generally denoted by 1, each head portion 3 of the rails 2 being supported at the rail outer side via an elastomer profile 4 on a console ledge 5, and at the rail inner side via an elastomer profile 6 on a console ledge 7. The elastomer profiles 4, 6 extend from the head portion 3 to the foot portion 8, the elastomer profiles 4, 6 being compressed by the console ledges 5, 7 so that the rails 2 are fixed in the lateral direction.

Figure 3:
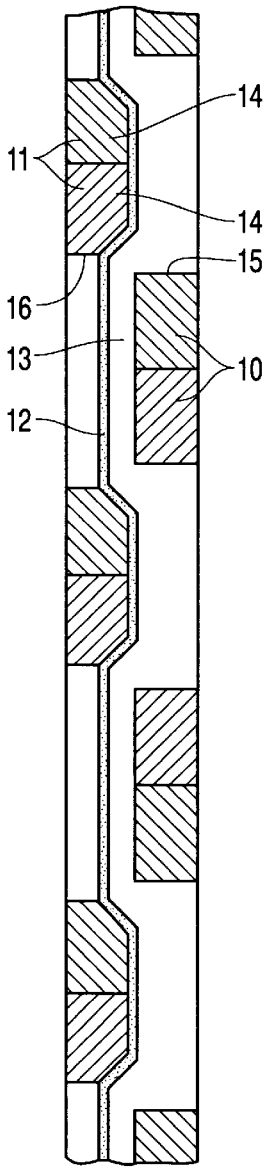
FIG. 3 shows a longitudinal middle section of the track according to FIG. 2.
Figure 2:
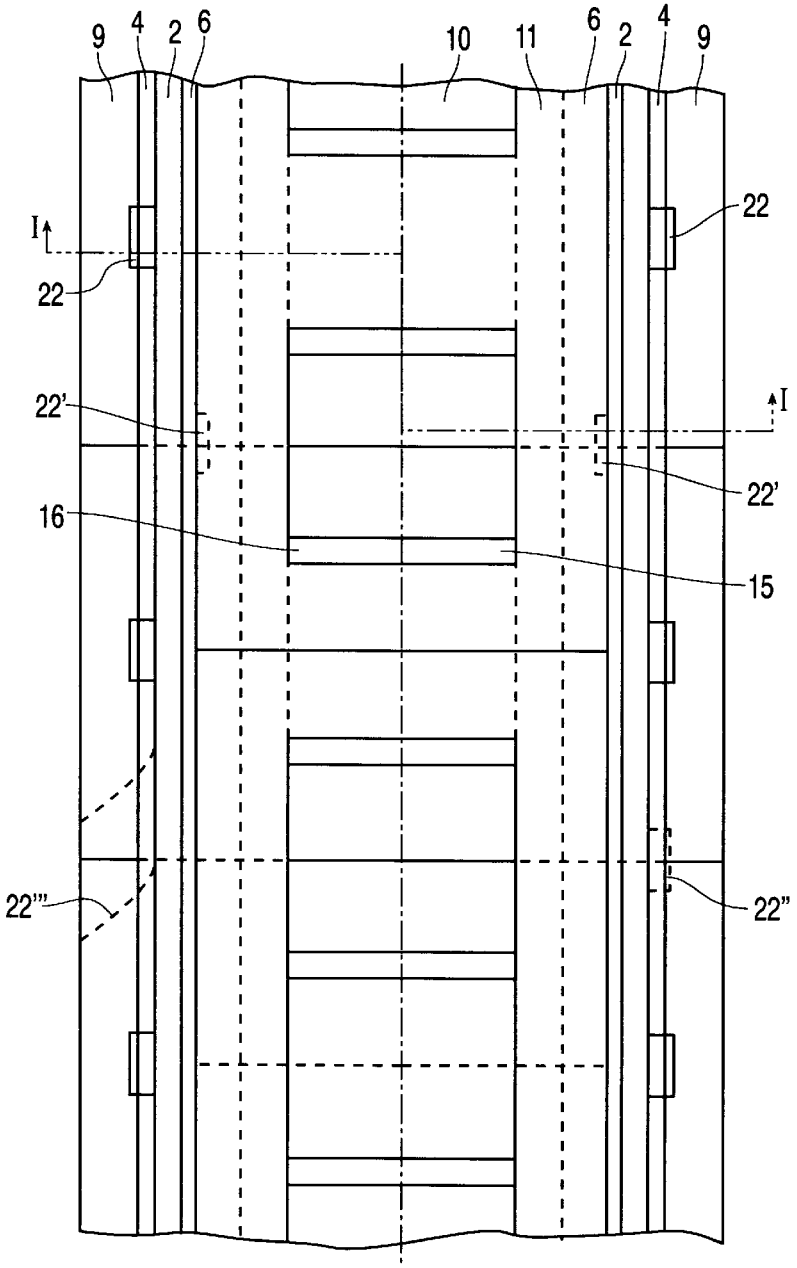
FIG. 2 shows a top view on the track according to FIG. 1.

The two console ledges 5 at the rail outer side are arranged so as to be integrated on upwardly extending side portions 9 of a base plate 10 of rectangular ground plan and lying underneath the rails 2. Similarly, the two console ledges 7 on the rail inner side are arranged so as to be integrated on the lateral ends of an inner plate 11 of rectangular ground plan, which inner plate 11 lies between the rails 2 and above the base plate 10 and is supported on the base plate 10 via elastomer bands 12. As is apparent from FIGS. 2 and 3, the base plate 10 and the inner plate 11 have equal lengths, yet they are arranged to be offset relative to each other by half a length. To prevent a mutual displacement of the plates 10, 11, each base plate 10 has two spaced apart, upwardly directed longitudinal ribs 13 which are interrupted in their middle region or have a reduced height so as to form a recess for accommodating longitudinal ribs 14 at the end regions of the inner plate 11 which are aligned with the longitudinal ribs 13 and are directed downwardly, the longitudinal ribs 13, 14 being formed to be slanted to the respective plate body of the base plate 10 or to the inner plate 11, respectively, at the mutual transitions and their heights being dimensioned such that a gap is formed to receive the elastomer bands 12 lying between the longitudinal ribs 13, 14. By this design, the longitudinal ribs 13, 14 engage in the complementary projections and recesses formed between the longitudinal ribs like a toothing when the plates 10, 11 are assembled and form a positive connection in the longitudinal direction.

Figure 4:
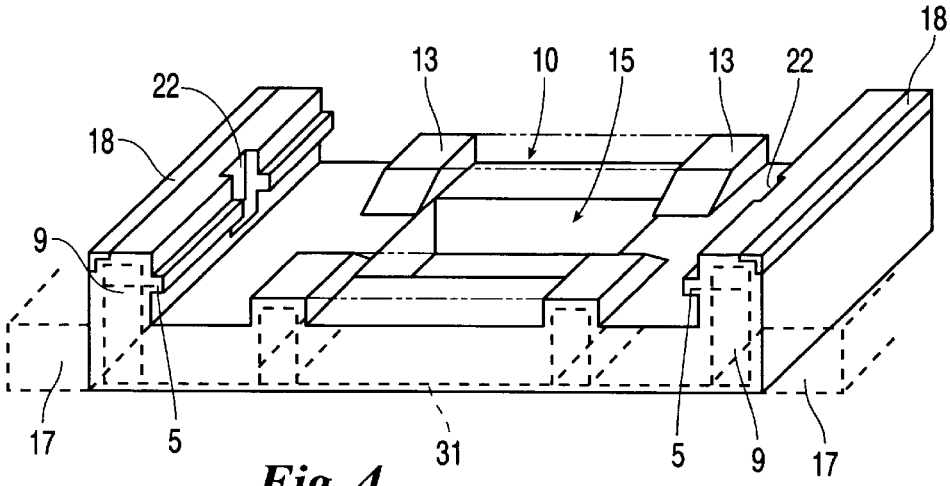
FIG. 4 is a perspective illustration of a base plate.

The base plates 10 and the inner plates 11 may be produced as finished parts, ferroconcrete, polymer bonded concrete, or special concrete, e.g. with additives, being preferably used, and the plates 10, 11, if desired, may be provided with reinforcements (not shown). The base plate 10 may also be produced by site-mixed concrete construction. To save material, the plates 10, 11 furthermore are each provided with a rectangular recess 15 or 16, respectively, in their middle, which recesses are laterally followed by the longitudinal ribs 13 and 14, respectively. Due to the recesses 15 or 16, respectively, the plates 10, 11 get the shape of a frame which optionally is provided with a closed bottom at its lower side. Furthermore, to increase the load bearing capacity, the base plate 10 may include a broadening portion 17 departing from the lateral portions 9 and comprising reinforcements, as is indicated in dot-and-dash lines in FIG. 4. To further increase the load bearing capacity of the base plate 10, the space between the two ribs 13 in the region externally of the recess 15 may be filled with material to be level therewith, as is illustrated in FIG. 4 by two-dots/one-dash lines. The same may be done at the inner plate 11.

To define the electric potential of the base plate 10, preferably angle profiles 18 made of metal are provided at the upper end of the side portions 9, which angle profiles may be conductively interconnected and/or connected to ground.

Figure 5:
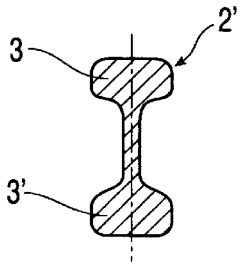
FIG. 5 shows a cross-section of a rail profile for a track according to the invention.

In FIG. 5 a rail 2' is illustrated which comprises a second head portion 3' instead of a foot portion, so that after an excessive wear, particularly on the wheel flange side, the rail 2' may be removed and re-inserted upside down. Each rail 2' thus altogether may be used four times.

Figure 6:
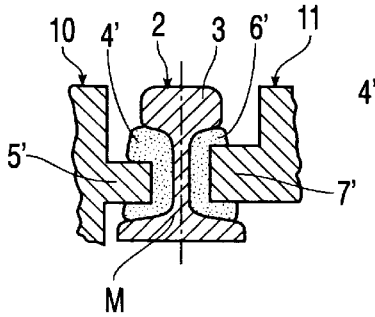
FIG. 6 shows a cross-section of a detail of a rail supported on the base plate and on the inner plate.

FIG. 6 shows an arrangement in which the height of the elastomer profile 4' at the rail outer side below the head portion 3 exceeds the height of the elastomer profile 6' at the rail inner side so as to equalize the resilient deflections of the elastomer profile 6' and the elastomer bands 12. At the same time, by choosing a suitable height of the elastomer profile 6', the rail 2 may be forced to assume an inwardly inclined position, as is indicated by the second, inclined middle axis M in FIG. 6, so that the rails adapt to the conically turned running surfaces of a wheel tire and the wheel flange is not subjected to wear.

Figure 7:
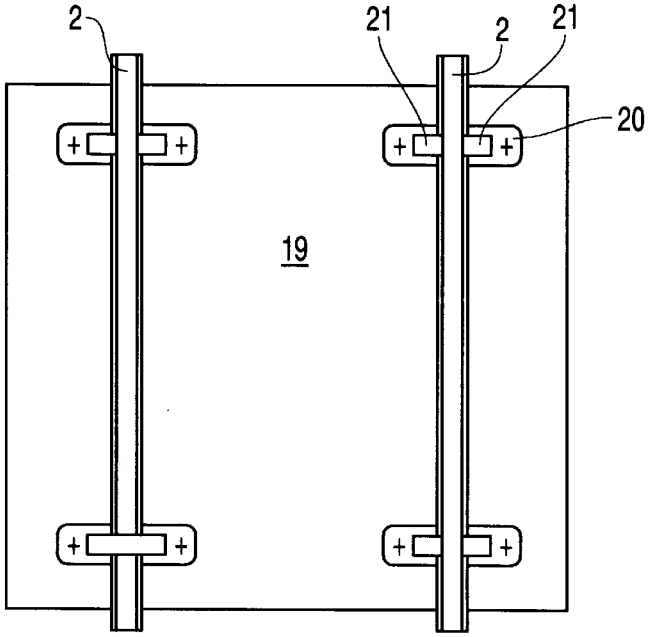
FIG. 7 shows a top view of a rail attachment.

For safety and revision reasons, the rails 2 are rigidly connected with a base 19 at fixed locations at intervals of from 10 to 60 m, as is illustrated in FIG. 7.

To connect the rails 2 with the base 19, e.g. four metal plates 20 anchored in the base are used, conventional rail fastening elements 21, e.g. clamping plates, spring clamps or the like, being attached to the metal plates to clamp the rails 2. The length of the base may be approximately 0.5 to 1 m. By this arrangement, an excursion of the rails 2 in the lateral and longitudinal directions is prevented.

Figure 8:
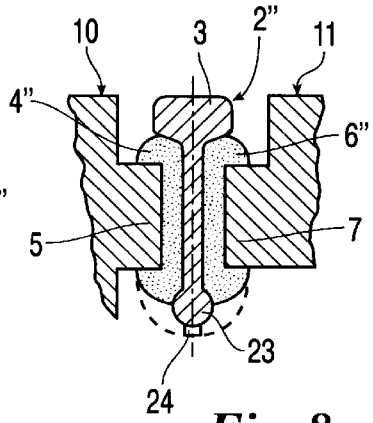
FIG. 8 shows a cross-section of a detail of a rail supported on the base plate and on the inner plate.

With the rail 2" illustrated in FIG. 8, the foot portion is designed as a bead 23, the two elastomer profiles 4" and 6" in the disassembled state each having a width corresponding to half the distance between the two console ledges 5 and 7. The two elastomer profiles 4" and 6" can also be designed in one piece by being connected at their lower ends, as is illustrated in broken lines. In the transition region, apertures 24 will be provided in spaced relationship which allow for an exit and access, respectively, of air when the rail 2" is installed and removed.

For level road crossings, at least the inner plate 11 is formed without a recess 16. To make arcuate trackways, the ground plan of the base plate 10 has the shape of a isosceles trapezoid, while the shape of the inner plate 11 which overlaps two halves of the base plates 10 each accordingly has a ground plan of two assembled non-isosceles trapezoids.

To install the rails 2, 2' between the base plate 10 and the inner plate 11, central recesses 22 are provided on the internal side of the side portions 9 of the base plate 10, which recesses allow for the introduction of an installation tool, e.g., the jaw of tongs. For the same purpose, recesses 22' may be provided on the external side of the inner plate 11, which are illustrated in broken lines in FIG. 2. Additionally, the base plates 10, at the sites of abutment, may be provided with a recess 22" similar to the recess 22 in the middle or with wider, slantedly extending recesses 22''', the latter serving to facilitate insertion of the elastomer profiles 4, 4' during mounting (cf. FIG. 2). To prevent an axial excursion of the elastomer profiles 4, 4', clamping retention means (not illustrated) are arranged in the region of the recesses 22'''. To reduce the running noise of the wheels, walls 25 of sound-absorbing material may be attached to one or both sides (cf. FIG. 1). In the region of the recesses 22, the elastomer profiles 4, 4' and the console ledges 5, 5' are interrupted.

During installation, at first the elastomer bands 12 are laid onto the longitudinal ribs of the base plate 10, and the rails 2, 2' are pressed at the console ledges 5 of the base plate 10 by means of tongs, whereupon the inner plate 11, possibly in a skewed position, is inserted in the base plate 10. Then the elastomer profiles 6, 6' are slid in between the console ledges 7 of the inner plate 11 and the rails 2, 2' in track direction. Subsequently, the rails 2, 2' are pressed together from the outside by means of the tongs, and the elastomer profiles 4, 4' are slid in or drawn in, preferably via the recesses 22''', between the console ledges 5 of the base plate 10 and the rails 2, 2'.

With a second type of installation, at first the elastomer profiles 6, 6' are mounted on the console ledges 7 of the inner plate 11, and subsequently the rails 2, 2' are laid onto the elastomer profiles 6, 6' at the outer side thereof. Then the rails 2, 2' are pressed together from the outside by means of the tongs, so that the distance between the rails is reduced. Subsequently, this assembly is inserted between the console ledges 5 of the base plate 10, in which the elastomer bands 12 have previously been laid onto the longitudinal ribs 13, the jaws of the tongs entering into the recesses 22, whereupon the elastomer profiles 4, 4' are mounted on the console ledges 5 of the base plate 10 by sliding in. When the tongs are released, the rails 2, 2' are braced, whereupon the jaws of the tongs are withdrawn from the recesses 22.

A third type of installation of the rail 2" according to FIG. 8 consists in that at first the elastomer bands are inserted, and the inner plates 11 are inserted in the base plate 10, subsequently the rails 2" on both sides are provided with the elastomer profiles 4, 4' and 6, 6', respectively, whereupon this assembly, if desired with a metal sheet strip interposed, is pressed in between the console ledges 5 and 7, respectively, with pressure being applied from the top.

A fourth type of installation of the rails 2" according to FIG. 8 consists in that at first the elastomer profiles 4, 4' and 6, 6', respectively, are attached to the console ledges 5 and 7, respectively, whereupon the rails 2" are pressed in with pressure being applied from the top and are secured in that position by the bead 23.

As there exist various shapes of rail sections, the console ledges 5 and 7 and the elastomer profiles 4, and 6, respectively, can be adapted to the head portions, webs and foot portions of these sections.

The distance of the console ledges 5 and 7, respectively, to the upper side of the base plate 10 is chosen such that the foot portion 8, 8' of the rail 2 extends always—i.e., also if under load—at a distance to the upper side of the base plate 10. The above-mentioned inclined position of the rail 2 may also be achieved in that the distance of the console ledges 5 at the rail outer side to the upper side of the base plate 10 is chosen to exceed the distance of the console ledge 7 at the rail inner side to the upper side of the base plate 10.

To produce rails having a reduced width of the foot portion, rails of normal section can be used whose foot portion is reduced to the required width on one or both sides by cutting by means of a flame cutter or a laser.

The elastomer profiles 4, 4' and 6, 6' may either be slid in at each plate unit in cut-to-length state, or they may be slid in or drawn in via the recesses 22"' by using a lubricant.

For a more favorable pressure distribution, the upper seat-engaging surface of the console ledges 5, 7 of the base plate 10 and of the inner plate 11 may extend substantially in parallel to the lower seat-engaging surface of the head portion 3 of the rails 2, 3, i.e. at an inclination.

What is claimed is:

1. A track assembly comprising a pair of parallel spaced apart rails each having an enlarged head, a plurality of longitudinal base plates adapted to be mounted on a track bed and having a pair of opposed laterally spaced inwardly projecting first console ledges and a plurality of inner plates supported on said longitudinal base plates between said first console ledges and having a pair of oppositely extending second console ledges, said rails being supported in spaced relation above said longitudinal base plates by said first and second console ledges via intermediate elastic inserts engaged between said rails and said first and second console ledges beneath said enlarged head of each rail.

2. A track assembly according to claim 1, wherein the base plates and the inner plates are reinforced structures.

3. A track assembly according to claim a 1, wherein the base plates each comprise upwardly projecting side portions on which the first console ledges are integrally formed and wherein the second console ledges are integrally formed on opposite lateral sides of each inner plate.

4. A track assembly according to claim 2, herein the base plates each comprise upwardly projecting side portions on which the first console ledges are integrally formed and wherein the second console ledges are integrally formed on opposite lateral sides of each inner plate.

5. A track assembly according to claim 1, wherein the base plates and the inner plates have equal lengths and are arranged longitudinally offset relative to each other.

6. A track assembly according to claim 1, wherein the base plates are provided with at least one upstanding longitudinal rib for supporting the inner plates on the base plates.

7. A track assembly according to claim 2, wherein the base plates are provided with at least one upstanding longitudinal rib for supporting the inner plates on the base plates.

8. A track assembly according to claim 1, wherein the inner plates are provided with at least one longitudinal rib directed downwardly for supporting the inner plates on the base plates.

9. A track assembly according to claim 2, wherein the inner plates are provided with at least one longitudinal rib directed downwardly for supporting the inner plates on the base plates.

10. A track assembly according to claim 2, or claim 7, wherein an elastomer band is disposed between the longitudinal rib of each base plate and the inner plates supported thereon.

11. A track assembly according to claim 8, or claim 9, wherein an elastomer band is disposed between the longitudinal rib of each inner plate and the base plates.

12. A track assembly according to claim 6, wherein each base plate comprises two upwardly extending longitudinal ribs spaced from each other, said longitudinal ribs being interrupted adjacent a middle region thereof and each inner plate includes at opposite end regions two complementary longitudinal ribs which register with the longitudinal ribs of the base plate.

13. A track assembly according to claim 7, wherein each base plate comprises two upwardly extending longitudinal ribs spaced from each other, said longitudinal ribs being interrupted adjacent a middle region thereof and each inner plate includes at opposite end regions two complementary longitudinal ribs which register with the longitudinal ribs of the base plate.

14. A track assembly according to claim 8, wherein each base plate comprises two upwardly extending longitudinal ribs spaced from each other, said longitudinal ribs being interrupted adjacent a middle region thereof and each inner plate includes at opposite end regions two complementary longitudinal ribs which register with the longitudinal ribs of the base plate.

15. A track assembly according to claim 9, wherein each base plate comprises two upwardly extending longitudinal ribs spaced from each other, said longitudinal ribs being interrupted adjacent a middle region thereof and each inner plate includes at opposite end regions two complementary longitudinal ribs which register with the longitudinal ribs of the base plate.

16. A track assembly according to claim 12, 13, 14 or 15, wherein the longitudinal ribs on the base plate and the longitudinal ribs on the inner plate are provided with complementary chamfered surfaces to facilitate interfitting.

17. A track assembly according to claim 1, wherein each base plate and each inner plate are provided in a middle portion thereof with a recess to form a frame.

18. A track assembly according to claim 2, wherein each base plate and each inner plate are provided in a middle portion thereof with a recess to form a frame.

19. A track assembly according to claim 17, or claim 18, wherein the frame is provided with a closed bottom.

20. A track assembly according to claim 1, wherein each base plate and each inner plate are prefabricated parts.

21. A track assembly according to claim 2, wherein each base plate and each inner plate are prefabricated parts.

22. A track assembly according to claim 20, or claim 21, wherein each base plate and each inner plate are comprised of polymer bonded concrete or special concrete.

23. A track assembly according to claim 1, or claim 2, comprising base plates made of site-mixed concrete.

24. A track assembly according to claim 3, wherein said upwardly projecting side portions are provided with longitudinally extending metal profiles with the metal profiles of adjacent base plates each being electrically interconnected or grounded.

25. A track assembly according to claim 1, wherein said rails are provided with an enlarged foot portion and a narrower web portion interconnecting each head and foot portion and wherein said elastic intermediate inserts are shaped to engage the head portion, the web and the foot portion of each rail.

26. A track assembly according to claim 25, wherein said enlarged foot portion and said head portion of each rail are of equal width and shape.

27. A track assembly according to claim 25, wherein the width of each enlarged foot portion of the rails is equal to or smaller than the distanced between the first and second console ledges.

28. A track assembly according to claim 1, wherein said base plates and said inner plates are designed to have a rectangular-shaped ground plan and have equal lengths with the base plates and the inner plates being longitudinally offset relative to each other.

29. A track assembly according to claim 1, wherein said elastic inserts adjacent an outer side of each rail below the head portion have a height exceeding a height of the elastic insert adjacent an inner side of each rail.

30. A track assembly according to claim 1, wherein the distance of said first console ledges to the upper side of the base plates exceeds the distance of the second console ledges to the upper side of the base plates.

31. A track assembly according to claim 1, comprising base plates which are prefabricated and rigid connections between said base plates and a track bed at intervals from 10 to 60 m.

32. A track assembly according to claim 31, further comprising metal plates secured to said base plates and a plurality of rail fastening elements being secured to said metal plates.

33. A track assembly according to claim 1, comprising metal plates arranged at intervals from 10 to 60 m and being connected directly to a track bed and a plurality of rail fastening elements being secured to said metal plates.

34. A track assembly according to claim 3, further comprising central recesses being provided on an inner side of said upstanding side portions with the first console ledges and adjacent elastic inserts being interrupted in the region of the recesses.

35. A track assembly according to claim 34, further comprising recesses on the outer side of the side portions of the inner plates.

36. A track assembly according to claim 3, or claim 4, comprising base plates provided with projections outwardly extending adjacent the side portions of the base plates.

37. A track assembly according to claim 1, wherein each rail is provided with a foot portion in the form of an enlarged bead with each elastic insert having in its disassembled state a width corresponding to half a distance between said first and second console ledges.

38. A track assembly according to claim 3, comprising base plates which are provided at their side portions at abutment sides with a recess.

39. A track assembly according to claim 3, comprising base plates having a slanted recess provided on a side portion extending from an outside thereof to an inside portion thereof adjacent abutment sites.

40. A track assembly as set forth in claim 1, further comprising walls of sound-absorbing material secured to at least one side of each base plate.

41. A track assembly as set forth in claim 1, wherein said first and second console ledges are provided with upper seat-engaging surfaces which extend substantially parallel to lower seat engaging surfaces of the head portion of each rail.

* * * * *